United States Patent [19]

Salvatini

[11] Patent Number: 4,723,492

[45] Date of Patent: Feb. 9, 1988

[54] SHELF APPARATUS

[76] Inventor: Dominick A. Salvatini, 3 Roslyn Rd., Trenton, N.J. 08610

[21] Appl. No.: 69,067

[22] Filed: Jul. 2, 1987

[51] Int. Cl.[4] ..... A47B 23/00

[52] U.S. Cl. ..... 108/42; 248/174

[58] Field of Search ..... 108/42; 248/174; 211/135, 73; 206/44, 45

[56] References Cited

U.S. PATENT DOCUMENTS

| | | | |
|---|---|---|---|
| 1,495,943 | 5/1924 | Wiley . | |
| 1,889,002 | 11/1932 | Palicki | 248/174 X |
| 1,933,374 | 10/1933 | Haggard . | |
| 2,049,638 | 8/1936 | Bennett . | |
| 2,115,243 | 4/1938 | Schmidt | 211/135 X |
| 2,465,635 | 3/1949 | Conterio . | |
| 2,550,959 | 5/1951 | Bowman | 248/174 X |
| 2,564,259 | 8/1951 | Hoglund . | |
| 2,888,148 | 5/1959 | Meyers . | |
| 2,900,667 | 8/1959 | Longenecker . | |
| 2,944,677 | 7/1960 | Stumpf, Jr. . | |
| 2,957,584 | 10/1960 | Jenkins . | |
| 3,139,192 | 6/1964 | Maguire . | |
| 3,193,108 | 7/1965 | Johnson . | |

FOREIGN PATENT DOCUMENTS

| | | | |
|---|---|---|---|
| 1296657 | 3/1962 | France | 248/174 |

*Primary Examiner*—Peter A. Aschenbrenner

*Attorney, Agent, or Firm*—Sperry, Zoda & Kane

[57] ABSTRACT

A shelf apparatus including a shelf support structure formed of two rear panel members, two side panel members and a front panel member all preferably being of triangular shape and joined at the lowermost edges thereof to provide vertical support for a shelf structure including a shelf member and frontwardly downwardly extending edge thereof. The shelf support structure preferably is of a paper or card stock material to minimize cost and to still allow for sufficient strength to support as much as three or four pounds of load. The shelf may include a front lowermost edge being decorative and also includes a mounting system utilizing push-pins or thumbtacks for securing the entire structure to the vertically extending wall area thereadjacent.

19 Claims, 3 Drawing Figures

SHELF APPARATUS

BACKGROUND OF THE INVENTION

1. Field Of The Invention

The present invention deals with the field of economical easily assembled shelving configurations formed of heavy paper which can support relatively lightweight items in the range of 3 to 5 lbs. when thumbtacked or attached to the wall area by pushpins or the like. These devices are particularly usable in schools, where a great number of displays of different items on bulletin boards or wall areas are required.

The present invention is capable of being sold in large quantities as paper blanks and can be easily and quickly assembled and after the desired usage is completed can be discarded due to the extremely low cost thereof in view of the fact that they are made from paper or paper stock materials.

2. Description Of The Prior Art

Many devices have been conceived for providing display supports such as those in U.S. Pat. No. 1,495,943 issued May 27, 1924 to B. Wiley on a Displaying Support; U.S. Pat. No. 1,933,374 issued Oct. 31, 1933 to J. Haggard on a Window Display Shelf; U.S. Pat. No. 2,049,638 issued Aug. 4, 1936 to A. Bennett on an Advertising Bracket Sign; U.S. Pat. No. 2,465,635 issued Mar. 29, 1949 to J. Conterio on a Corner Wall Shelf; U.S. Pat. No. 2,564,259 issued Aug. 14, 1951 to A. Hoglund on a Variety Shelf; U.S. Pat. No. 2,888,148 issued May 26, 1959 to H. Meyers on Shelf Extenders; U.S. Pat. No. 2,900,667 issued Aug. 25, 1959 to J. Longenecker on a Method Of Making A One-Piece Display Device; U.S. Pat. No. 2,944,677 issued July 12, 1960 to H. Stumpf, Jr. on a Shelf Extender Display Or Storage Device; U.S. Pat. No. 2,957,584 issued Oct. 25, 1960 to M. Jenkins on a Folding Disposable Toothbrush Rack; U.S. Pat. No. 3,139,192 issued June 30, 1964 to A. Maguire on a Knock-Down Cardboard Shelf Structure; and U.S. Pat. No. 3,193,108 issued July 6, 1965 to R. Johnson on a Shelf Extender.

SUMMARY OF THE INVENTION

The present invention provides a shelf apparatus which is particularly adapted for mounting to a vertically extending wall area and is particularly usable when made from thin construction material such as paper or card stock.

The present invention includes a shelf support structure having a first rear panel means extending vertically along the vertically extending wall area and capable of securement thereto. The first rear panel means also includes a first rear upper panel section along the upper portion thereof. A first side panel means is preferably secured along one lateral edge of the first rear panel means and extends outwardly therefrom from the wall and is preferably perpendicular with respect thereto.

A second rear wall means extends vertically along the wall area and is positioned in abutting contact extending over the first rear panel means and is secured thereto. The second rear panel means includes a second rear upper panel section along the upper portion thereof in abutting contact with respect to the first rear upper panel section and securable with respect to the wall area therewith.

A second side panel means is secured along a lateral edge of the second rear panel means laterally spaced from the first side panel means and extending outwardly therefrom preferably being perpendicular with respect thereto.

A front panel member extends from the first side panel to the second side panel and is generally spatially disposed with respect to the wall area but is in close proximity therewith at the lowermost edge thereof. The front panel means includes a front upper panel section extending approximately vertically downwardly along the upper portion thereof.

A first horizontal flap is attached with respect to the uppermost edge of the first side panel. A second horizontal flap is attached with respect to the uppermost edge of the second side panel. The first and second horizontal flaps are securable with respect to one another such as by gluing to provide an overall stability to the shelf support structure laterally.

The shelf structure adapted to be mounted upon the shelf support structure includes a shelf being generally rectangular in shape and extending horizontally and adapted to be positioned directly on top of the shelf support structure. The shelf structure includes a shelf securement flap attached along the innermost edge of the shelf and adapted to be secured with respect to the first upper panel and a second rear upper panel and to the wall area by the mounting means such as thumbtacks or the like. A shelf edge means is adapted to extend downwardly from the front edge of the shelf to be secured with respect to the front upper panel section and to provide a decorative lower edge thereof if desired.

Preferably the present invention further includes a tacking means adapted to extend through the first rear panel and the second rear panel into the vertically extending wall area to facilitate securement thereto. The tacking means can also extend through the first rear upper panel and the second rear upper panel as well as the shelf securement flap to further facilitate this mounting.

Preferably the material from which the shelf support structure and the shelf structure are made will be a paper-type material. This paper material could be normal paper, cardboard, oak tag paperboard, or heavy paper stock. Any of these materials will provide an inexpensive base material from which the shelf apparatus of the present invention can be made and yet will also provide a sufficient amount of strength for mounting items in the 3 to 5 lb. range.

To facilitate the overall strength of the shelf support apparatus it is preferable that the first and second rear panels as well as the first and second side panels are triangular in shape. It is also preferable that the first rear panel and the second rear panel are glued with respect to one another. When assembled also preferably the shelf edge means can be secured with respect to the front upper panel section to facilitate perpendicular strength with respect to the vertically extending wall area.

It is an object of the present invention to provide a shelf apparatus adapted for mounting to a vertically extending wall area wherein inexpensive construction materials are utilized such as paper or card stock or oak tag.

It is an object of the present invention to provide a shelf apparatus adapted for mounting to a vertically extending wall area wherein the shelf and shelf support structure is formed in flat paper blanks to facilitate shipping and handling thereof.

It is an object of the present invention to provide a shelf apparatus adapted for mounting to a vertically extending wall area wherein the shelf and shelf support apparatus is easily constructable.

It is an object of the present invention to provide a shelf apparatus adapted for mounting to a vertically extending wall area wherein the cost of materials is so minimal as to make the apparatus disposable.

It is an object of the present invention to provide a shelf apparatus adapted for mounting to a vertically extending wall area wherein maintenance requirements are virtually eliminated.

It is an object of the present invention to provide a shelf apparatus adapted for mounting to a vertically extending wall area wherein assembly of the shelf and shelf support structure requires minor glue attachments and tack attachments.

It is an object of the present invention to provide a shelf apparatus adapted for mounting to a vertically extending wall area wherein different colors of paper stock can be utilized to enhance appearance of the final product.

It is an object of the present invention to provide a shelf apparatus adapted for mounting to a vertically extending wall area wherein a decorative lower edge to the shelf is provided for further aesthetic enhancement.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
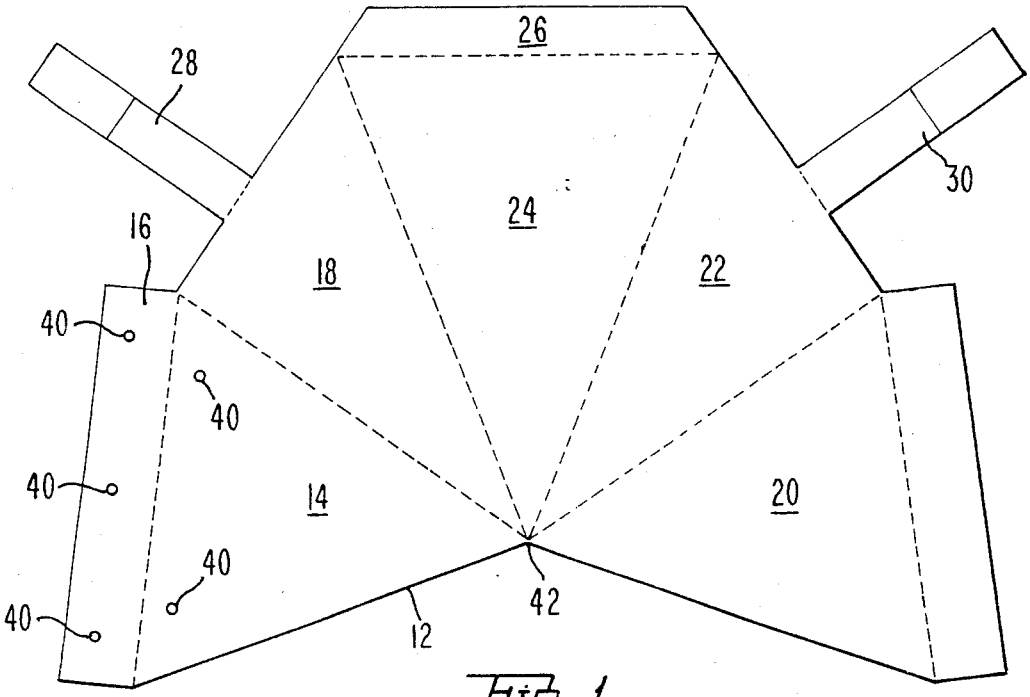
FIG. 1 is a top plan view of a blank of an embodiment of the shelf support structure of the present invention.
Figure 2:
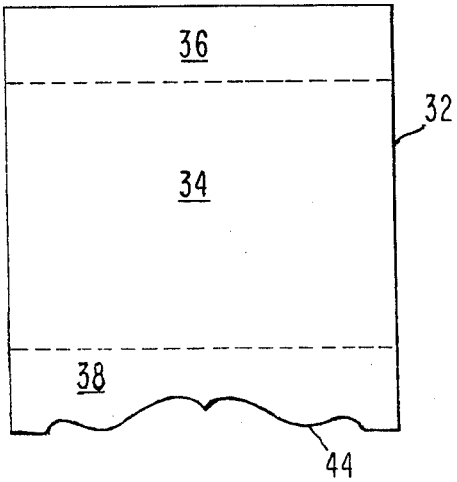
FIG. 2 is a top plan view of a blank of an embodiment of the shelf structure of the present invention.
Figure 3:
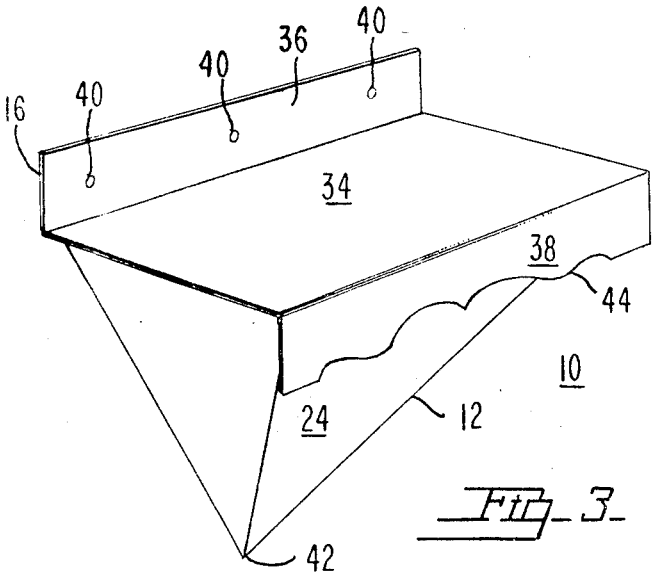
FIG. 3 is a front three-quarter perspective view of an embodiment of the present invention showing the shelf apparatus mounted upon adjacent wall area.

The shelf apparatus of the present invention is particularly adapted for use with a vertically extending adjacently positioned wall area. The shelf apparatus of the present invention is preferably formed of a paper stock or cardboard material to minimize cost and to facilitate ease of assembly.

With the present invention a shelf support structure 12 is included to be positioned adjacent to the wall area 10 to which it will be mounted. Shelf support structure 12 includes a first rear panel means 14 with a first rear upper panel section 16 extending along the uppermost edge thereof. A first side panel means 18 extends along one lateral edge of the first rear panel means 14 and extends outwardly therefrom approximately perpendicular with respect thereto.

A second rear panel means 20 is adapted to extend over the first rear panel means 14 and be secured with respect thereto. A second side panel means 22 extends outwardly from the second rear panel means along one edge thereof in such a manner as to be approximately perpendicular therefrom.

A front panel means 24 preferably extends between the outermost edges of the first side panel means 18 and the second side panel means 22. A front panel means 24 preferably is triangular in shape with the lowermost point thereof in abutment with respect to the first rear panel means 14 and/or the second rear panel means 20 which themselves are in abutment directly with respect to the wall area 10 at the lowermost edge 42 thereof. Thus the front panel means 24 will extend upwardly and outwardly from the wall area 10 adjacent the lowermost edge of abutment 42.

Front panel means 24 will include a front upper panel section 26 along the uppermost edge thereof which preferably extends vertically downwardly to facilitate mounting of the shelf means thereon.

To provide lateral or horizontal support a first horizontal flap means 28 may be secured with respect to the first side panel means 18 and particularly with respect to the uppermost edge thereof. Similarly a second horizontal flap means 30 will preferably be secured with respect to the second side panel means 22 to extend horizontally outwardly therefrom. First horizontal flap means 28 and second horizontal flap 30 should be of sufficient length to overlap one another such that when glued together they provide additional lateral and horizontal support to the shelf support structure 12.

The present invention further includes a shelf structure 32 which is adapted to be mounted upon the shelf support structure 12. Shelf structure 32 includes a shelf means 34 is generally rectangular and extends horizontally when mounted upon shelf support structure 12. Shelf structure 32 includes a shelf securement flap 36 along the rearmost edge thereof which is adapted to be secured with respect to the adjacently positioned wall area. Also the shelf structure 32 includes a shelf edge means 38 along the front most portion of shelf means 34 which extends downwardly therefrom and is adapted to be secured such as by being glued with respect to the front upper panel section 26 extending downwardly to provide a front shelf edge. Also the shelf edge means 38 may include a decorative lower edge means 44 which may be scalloped or otherwise decoratively formed to provide an overall aesthetically pleasing structure to the shelf apparatus of the present invention.

To facilitate mounting of the shelf apparatus of the present invention with respect to wall area 10, a tacking means 40 may be included. Tacking means 40 may take the form of conventional tacks or pushpins or nails or the like which may extend through the first rear panel means 14 and the second rear panel means 20 to secure the shelf support structure 12 with respect to the wall area 10. To further facilitate securement similar tacking means 40 can be utilized extending through the shelf securement flap 36 and also simultaneously through the first rear upper panel section 16 and the second rear upper panel section 21 to facilitate securement of the upper portion including the shelf means 34 with respect to the wall area 10. Second rear upper panel section 21 is defined in the uppermost portion of the second rear panel means 20.

The shelf apparatus of the present invention is designed to include a shelf support structure 12 and a shelf structure 32 which are both initially formed as a paper or cardboard blank which can be cut and folded along the lines to facilitate construction of the shelf apparatus. The utilization of paper or card stock material such as oak tag for this purpose greatly enhances marketability of the design in view of the extremely low cost and ease of packaging thereof.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A shelf apparatus adapted for mounting to a vertically extending wall area, and being particularly usable made from thin construction materials such as paper or card stock, comprising:

(a) a shelf support structure comprising:

(1) a first rear panel means extending vertically along a wall area and being securable thereto, said first rear panel means including a first rear upper panel section along the upper portion thereof;

(2) a first side panel means secured along one lateral edge of said first rear panel means and extending outwardly therefrom and from the wall area;

(3) a second rear panel means extending vertically along a wall area and positioned in abutting contact extending over said first rear panel means and secured thereto, said second rear panel means including a second rear upper panel section along the upper portion thereof in abutting contact with respect to said first rear upper panel section and being securable with respect to the wall area therewith;

(4) a second side panel means secured along a lateral edge of said second rear panel means laterally spaced from said first side panel means and extending outwardly therefrom and from the wall area;

(5) a front panel means extending from said first side panel means to said second side panel means, said front panel means including a front upper panel section extending approximately vertically downwardly along the upper portion thereof;

(6) a first horizontal flap means attached with respect to the uppermost edge of said first side panel means;

(7) a second horizontal flap means attached with respect to the uppermost edge of said second side panel means, said second horizontal flap means being also securable with respect to said first horizontal flap means to provide stability to said shelf support structure;

(b) a shelf structure securable with respect to said shelf support structure comprising:

(1) a shelf means extending generally horizontally and being adapted to be positioned upon said shelf support structure for supporting thereof;

(2) a shelf securement flap attached along the innermost edge of said shelf means and adapted to be secured with respect to said first rear upper panel section, said second rear upper panel section and the wall area; and (3) a shelf edge means attached along the outermost edge of said shelf means and adapted to be attached with respect to said front upper panel section to extend downwardly therewith.

2. A shelf apparatus adapted for mounting to a vertically extending wall area as defined in claim 1 wherein said shelf support structure and said shelf structure are made of paper.

3. A shelf apparatus adapted for mounting to a vertically extending wall area as defined in claim 1 wherein said shelf support structure and said shelf structure are made of cardboard.

4. A shelf apparatus adapted for mounting to a vertically extending wall area as defined in claim 1 wherein said shelf support structure and said shelf structure are made of oak tag paperboard.

5. A shelf apparatus adapted for mounting to a vertically extending wall area as defined in claim 1 wherein said first rear panel means and said second rear panel means are triangular.

6. A shelf apparatus adapted for mounting to a vertically extending wall area as defined in claim 1 wherein said first side panel means is triangular.

7. A shelf apparatus adapted for mounting to a vertically extending wall area as defined in claim 1 wherein said second side panel means is triangular.

8. A shelf apparatus adapted for mounting to a vertically extending wall area as defined in claim 1 wherein said front panel means is triangular.

9. A shelf apparatus adapted for mounting to a vertically extending wall area as defined in claim 1 further comprising tacking means adapted to extend through said first rear panel means and said second rear panel means into the vertically extending wall area to facilitate securement of the shelf apparatus thereto.

10. A shelf apparatus adapted for mounting to a vertically extending wall area as defined in claim 1 further comprising tacking means adapted to extend through said first rear upper panel means, said second rear upper panel means and said shelf securement flap into the vertically extending wall area to facilitate securement of the shelf apparatus with respect thereto.

11. A shelf apparatus adapted for mounting to a vertically extending wall area as defined in claim 1 wherein said first rear panel means is glued with respect to said second rear panel means.

12. A shelf apparatus adapted for mounting to a vertically extending wall area as defined in claim 1 wherein said shelf edge means is glued with respect to said front upper panel section.

13. A shelf apparatus adapted for mounting to a vertically extending wall area as defined in claim 1 wherein said shelf securement flap is glued with respect to said first rear upper panel section.

14. A shelf apparatus adapted for mounting to a vertically extending wall area as defined in claim 1 wherein said first horizontal flap means is glued with respect to said second horizontal flap means to provide stability to the shelf apparatus mounted to a vertically extending wall area.

15. A shelf apparatus adapted for mounting to a vertically extending wall area as defined in claim 1 wherein said first side panel means extends perpendicularly outwardly from said first rear panel means.

16. A shelf apparatus adapted for mounting to a vertically extending wall area as defined in claim 1 wherein said second side panel means extends perpendicularly outwardly from said second rear panel means.

17. A shelf apparatus adapted for mounting to a vertically extending wall area as defined in claim 1 wherein said front panel means is in abutment with said first rear panel means and said second rear panel means at the lowermost edge thereof and extends upwardly and outwardly therefrom.

18. A shelf apparatus adapted for mounting to a vertically extending wall area as defined in claim 1 wherein said shelf edge means includes a decorative lower edge means to enhance the outward appearance of the shelf apparatus mounted upon a vertically extending wall area.

19. A shelf apparatus adapted for mounting to a vertically extending wall area, and being particularly usable made from thin construction materials such as paper or card stock, comprising:

(a) a shelf support structure of paperboard comprising:

(1) a first rear panel means being triangular and extending vertically along a wall area and being securable thereto, said first rear panel means including a first rear upper panel section along the upper portion thereof;

(2) a first side panel means being triangular and secured along one lateral edge of said first rear panel means and extending perpendicularly outwardly therefrom and from the wall area;

(3) a second rear panel means being triangular and extending vertically along a wall area and positioned in abutting contact extending over said first rear panel means and glued thereto, said second rear panel means including a second rear upper panel section along the upper portion thereof in abutting contact with respect to said first rear upper panel section and being securable with respect to the wall area therewith;

(4) a second side panel means being triangular and secured along a lateral edge of said second rear panel means laterally spaced from said first side panel means and extending perpendicularly outwardly therefrom and from the wall area;

(5) a front panel means being triangular and extending from said first side panel means to said second side panel means and being positioned adjacent with respect to the wall area at the lowermost edge thereof and extending generally upwardly and outwardly therefrom, said front panel means including a front upper panel section extending approximately vertically downwardly along the upper portion thereof;

(6) a first horizontal flap means attached with respect to the uppermost edge of said first side panel means;

(7) a second horizontal flap means glued with respect to the uppermost edge of said second side panel means, said second horizontal flap means being also securable with respect to said first horizontal flap means to provide stability to said shelf support structure;

(b) a shelf structure of paperboard securable with respect to said shelf support structure comprising:

(1) a shelf means being rectangular and extending generally horizontally and being adapted to be positioned upon said shelf support structure for supporting thereof;

(2) a shelf securement flap attached along the innermost edge of said shelf means and attached with respect to said first rear upper panel section, said second rear upper panel section and the wall area; and (3) a shelf edge means glued along the outermost edge of said shelf means and adapted to be attached with respect to said front upper panel section to extend downwardly therewith, said shelf edge means including a decorative lower edge means to enhance the outward appearance of the shelf apparatus mounted upon a vertically extending wall area;

(c) a tacking means extending through said first rear panel means, said second rear panel means and said shelf securement flat into the vertically extending wall area to facilitate securement of the shelf apparatus thereto.

* * * * *